US009057269B2

(12) United States Patent
Bush

(10) Patent No.: US 9,057,269 B2
(45) Date of Patent: Jun. 16, 2015

(54) PILOTED SCROLL COMPRESSOR

(75) Inventor: James W. Bush, Skaneateles, NY (US)

(73) Assignee: BITZER Kuehlmaschinenbau GmbH, Sindelfingen (DE)

( * ) Notice: Subject to any disclaimer, the term of this patent is extended or adjusted under 35 U.S.C. 154(b) by 295 days.

(21) Appl. No.: 13/428,173

(22) Filed: Mar. 23, 2012

(65) Prior Publication Data

US 2013/0251568 A1 Sep. 26, 2013

(51) Int. Cl.

| | |
|---|---|
| ***F01C 1/02*** | (2006.01) |
| ***F01C 1/063*** | (2006.01) |
| ***F04C 2/00*** | (2006.01) |
| ***F04C 18/00*** | (2006.01) |
| ***F01C 17/06*** | (2006.01) |
| ***F04C 23/00*** | (2006.01) |
| ***F04C 18/02*** | (2006.01) |
| *F04C 29/00* | (2006.01) |

(52) U.S. Cl.

CPC ..... *F01C 17/066* (2013.01); *F04C 23/008* (2013.01); *F04C 29/0057* (2013.01); *F04C 18/0215* (2013.01)

(58) Field of Classification Search

CPC ..... F01C 17/066; F04C 23/008
USPC ..... 418/55.1–55.6, 57, 152, 179
See application file for complete search history.

(56) References Cited

U.S. PATENT DOCUMENTS

| | | | | |
|---|---|---|---|---|
| 35,216 | A | 5/1862 | Carton | |
| 4,992,033 | A * | 2/1991 | Caillat et al. | 418/55.3 |
| 5,178,526 | A | 1/1993 | Galante et al. | |
| 5,342,185 | A | 8/1994 | Anderson | |
| 5,407,335 | A * | 4/1995 | Caillat et al. | 418/55.1 |
| 5,427,511 | A | 6/1995 | Caillat et al. | |
| 5,482,450 | A | 1/1996 | Caillat et al. | |
| 5,580,230 | A | 12/1996 | Keifer et al. | |
| 5,897,306 | A | 4/1999 | Beck | |
| 6,293,767 | B1 | 9/2001 | Bass | |
| 6,398,530 | B1 | 6/2002 | Hasemann | |
| 6,560,868 | B2 | 5/2003 | Milliff et al. | |
| 6,648,616 | B2 | 11/2003 | Patel et al. | |
| 6,761,541 | B1 | 7/2004 | Clendenin | |
| 6,814,551 | B2 | 11/2004 | Kammhoff et al. | |
| 6,960,070 | B2 | 11/2005 | Kammhoff et al. | |
| 7,070,401 | B2 | 7/2006 | Clendenin et al. | |
| 7,112,046 | B2 | 9/2006 | Kammhoff et al. | |

(Continued)

OTHER PUBLICATIONS

U.S. Appl. No. 13/427,984, filed Mar. 23, 2012, Cullen et al.

(Continued)

*Primary Examiner* — Kenneth Bomberg
*Assistant Examiner* — Deming Wan
(74) *Attorney, Agent, or Firm* — Reinhart Boerner Van Deuren P.C.

(57) ABSTRACT

A scroll compressor that includes a housing and scroll compressor bodies disposed in the housing. The scroll bodies include a first scroll body and a second scroll body, where the first and second scroll bodies have respective bases and respective scroll ribs that project from the respective bases. The scroll ribs are configured to mutually engage, and the second scroll body is movable relative to the first scroll body for compressing fluid. A pilot ring engages a perimeter surface of the first scroll body to limit movement of the first scroll body in the radial direction. Further, the first scroll body has a radially-outward-projecting limit tab which abuts a portion of the pilot ring to limit movement of the first scroll body in one of the axial and rotational directions.

27 Claims, 12 Drawing Sheets

(56) References Cited

U.S. PATENT DOCUMENTS

| | | | | |
|---|---|---|---|---|
| 7,275,918 | B2 * | 10/2007 | Liang et al. | 418/55.5 |
| 7,819,638 | B2 | 10/2010 | Grimm et al. | |
| 7,918,658 | B2 | 4/2011 | Bush et al. | |
| 8,002,528 | B2 | 8/2011 | Hodapp et al. | |
| 2006/0245967 | A1 * | 11/2006 | Gopinathan | 418/55.4 |
| 2009/0068044 | A1 * | 3/2009 | Guo et al. | 418/55.1 |
| 2009/0185927 | A1 | 7/2009 | Duppert et al. | |
| 2011/0129377 | A1 * | 6/2011 | Huang et al. | 418/55.1 |

OTHER PUBLICATIONS

U.S. Appl. No. 13/427,991, filed Mar. 23, 2012, Rogalski.
U.S. Appl. No. 13/427,992, filed Mar. 23, 2012, Bessel et al.
U.S. Appl. No. 13/428,036, filed Mar. 23, 2012, Bush et al.
U.S. Appl. No. 13/428,165, filed Mar. 23, 2012, Heusler.
U.S. Appl. No. 13/428,172, filed Mar. 23, 2012, Roof et al.
U.S. Appl. No. 13/428,173, filed Mar. 23, 2012, Bush.
U.S. Appl. No. 13/428,026, filed Mar. 23, 2012, Roof.
U.S. Appl. No. 13/428,042, filed Mar. 23, 2012, Roof et al.
U.S. Appl. No. 13/428,072, filed Mar. 23, 2012, Wang et al.
U.S. Appl. No. 13/428,337, filed Mar. 23, 2012, Duppert et al.
U.S. Appl. No. 13/428,406, filed Mar. 23, 2012, Duppert.
U.S. Appl. No. 13/428,407, filed Mar. 23, 2012, Duppert et al.
U.S. Appl. No. 13/428,505, filed Mar. 23, 2012, Duppert et al.

* cited by examiner

PILOTED SCROLL COMPRESSOR

FIELD OF THE INVENTION

The present invention generally relates to scroll compressors for compressing refrigerant and more particularly to an apparatus for controlling and/or limiting at least one of relative axial, radial, and rotational movement between scroll members during operation of the scroll compressor.

BACKGROUND OF THE INVENTION

A scroll compressor is a certain type of compressor that is used to compress refrigerant for such applications as refrigeration, air conditioning, industrial cooling and freezer applications, and/or other applications where compressed fluid may be used. Such prior scroll compressors are known, for example, as exemplified in U.S. Pat. No. 6,398,530 to Hasemann; U.S. Pat. No. 6,814,551, to Kammhoff et al.; U.S. Pat. No. 6,960,070 to Kammhoff et al.; and U.S. Pat. No. 7,112,046 to Kammhoff et al., all of which are assigned to a Bitzer entity closely related to the present assignee. As the present disclosure pertains to improvements that can be implemented in these or other scroll compressor designs, the entire disclosures of U.S. Pat. Nos. 6,398,530; 7,112,046; 6,814,551; and 6,960,070 are hereby incorporated by reference in their entireties.

As is exemplified by these patents, scroll compressors assemblies conventionally include an outer housing having a scroll compressor contained therein. A scroll compressor includes first and second scroll compressor members. A first compressor member is typically arranged stationary and fixed in the outer housing. A second scroll compressor member is movable relative to the first scroll compressor member in order to compress refrigerant between respective scroll ribs which rise above the respective bases and engage in one another. Conventionally the movable scroll compressor member is driven about an orbital path about a central axis for the purposes of compressing refrigerant. An appropriate drive unit, typically an electric motor, is provided usually within the same housing to drive the movable scroll member.

In some scroll compressors, it is known to have axial restraint, whereby the fixed scroll member has a limited range of movement. This can be desirable due to thermal expansion when the temperature of the orbiting scroll and fixed scroll increases causing these components to expand. Examples of an apparatus to control such restraint are shown in U.S. Pat. No. 5,407,335, issued to Caillat et al., the entire disclosure of which is hereby incorporated by reference.

The present invention is directed towards improvements over the state of the art as it relates to the above-described features and other features of scroll compressors.

BRIEF SUMMARY OF THE INVENTION

In one aspect, embodiments of the invention provide a scroll compressor that includes a housing and scroll compressor bodies disposed in the housing. The scroll bodies include a first scroll body and a second scroll body, where the first and second scroll bodies have respective bases and respective scroll ribs that project from the respective bases. The scroll ribs are configured to mutually engage, and the second scroll body is movable relative to the first scroll body for compressing fluid. A pilot ring engages a perimeter surface of the first scroll body to limit movement of the first scroll body in the radial direction. Further, the pilot ring has a first radially-outward-projecting limit tab to limit movement of the first scroll body in at least one of the axial and rotational directions.

In a particular embodiment, movement of the first scroll body in the axial direction is limited by the first radially-outward-projecting limit tab, which is configured to axially abut, and fit within, a notch formed into a bottom portion of the pilot ring. In a more particular embodiment, the first radially-outward-projecting limit tab is attached to an outermost perimeter surface of the scroll rib of the first scroll body. In an even more particular embodiment, the first scroll body includes the first radially-outward-projecting limit tab and a second radially-outward-projecting limit tab, the first and second radially-outward-projecting limit tabs spaced approximately 180 degrees apart, and the pilot ring has two notches adapted to receive the first and second radially-outward-projecting limit tabs.

In a further embodiment, movement in the rotational direction is limited by a third radially-outward-projecting limit tab on the first scroll body, wherein the third radially-outward-projecting limit tab is located within a slot formed in the pilot ring, and wherein the third radially-outward-projecting limit tab rotationally abuts a side portion of its slot. In particular embodiments, the third radially-outward-projecting limit tab is attached to an outermost perimeter surface of the scroll rib of the first scroll body. In certain embodiments, the third radially-outward-projecting limit tab has an opening configured to receive an axially-projecting portion of a key coupling to limit rotational movement of the key coupling.

In certain embodiments, the pilot ring is configured to be removably attached to a crankcase, the first and second scroll bodies being disposed within the attached pilot ring and crankcase. Particular embodiments further include a key coupling that acts upon the second scroll body, the key coupling being disposed within the attached pilot ring and crankcase. In more particular embodiments, the pilot ring, crankcase, and key coupling have outer diameters that are approximately equal to the inner diameter of the housing. In further embodiments, the radial movement of the first scroll body is limited by a fit between the first scroll body and the pilot ring.

In a further embodiment, movement in the rotational direction is limited by the first radially-outward-projecting limit tab on the first scroll body, wherein the first radially-outward-projecting limit tab is located within a slot formed in the pilot ring, and wherein the first radially-outward-projecting limit tab rotationally abuts a side portion of the slot. Certain embodiments further include a key coupling that acts upon the second scroll body, and wherein the first radially-outward-projecting limit tab has an opening configured to receive an axially-projecting portion of the key coupling to limit rotational movement of the key coupling.

In another aspect, embodiments of the invention provide a method of compressing fluid in a scroll compressor. The method includes providing first and second scroll compressor bodies having respective bases and respective scroll ribs that project from the respective bases. The method further provides that the scroll ribs mutually engage and that the second scroll body is movable relative to the first scroll body for compressing fluid. In a particular embodiment, the method requires that the first scroll body include a plurality of radially-outward-projecting limit tabs. Further, the method includes limiting movement of the first scroll body in at least one of the radial, axial, and rotational directions with a pilot ring configured to engage the plurality of radially-outward-projecting limit tabs.

Other aspects, objectives and advantages of the invention will become more apparent from the following detailed description when taken in conjunction with the accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

Figure 1:
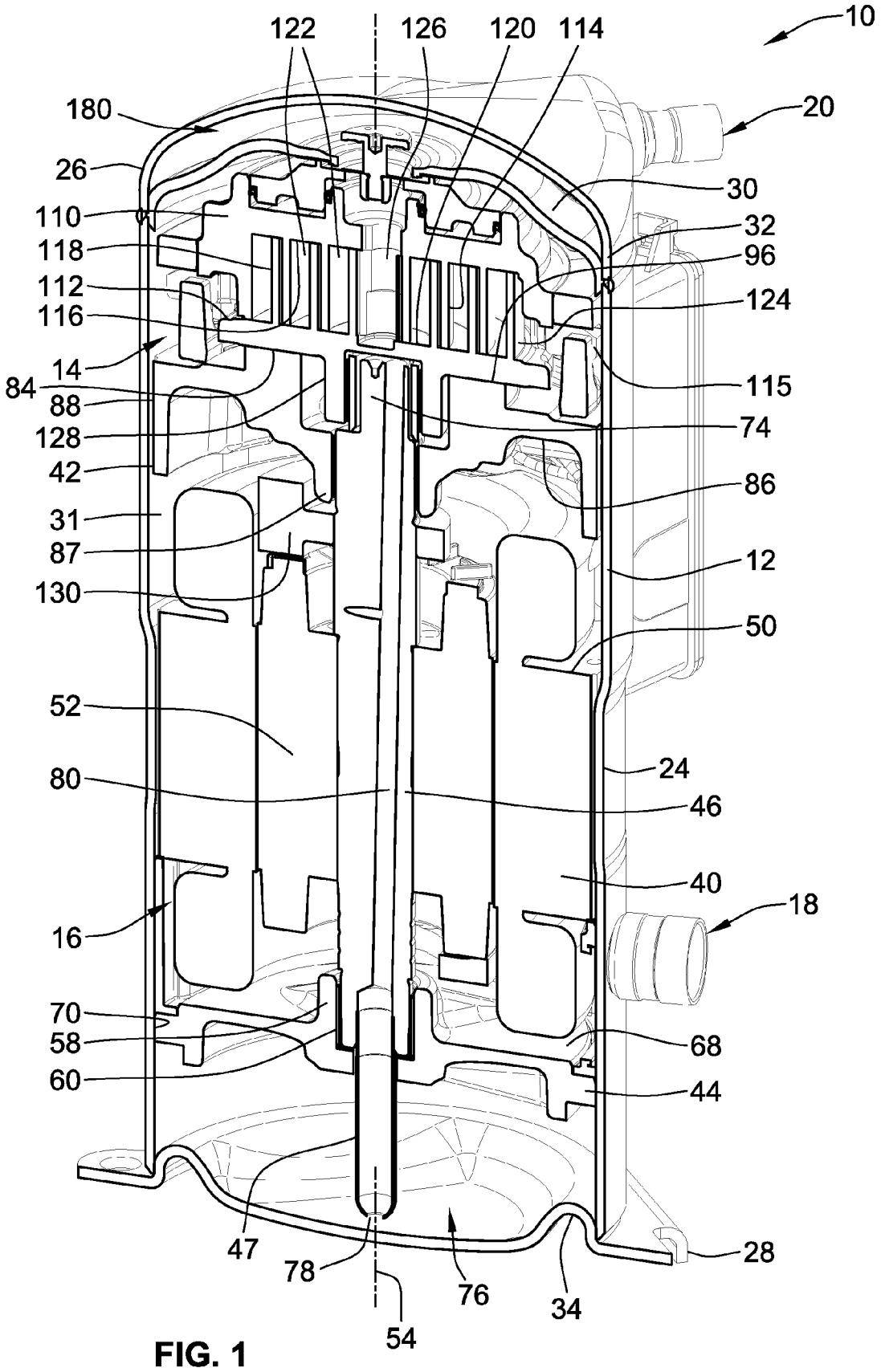
FIG. 1 is a cross-sectional isometric view of a scroll compressor assembly, according to an embodiment of the invention.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

An embodiment of the present invention is illustrated in the figures as a scroll compressor assembly 10 generally including an outer housing 12 in which a scroll compressor 14 can be driven by a drive unit 16. The scroll compressor assembly 10 may be arranged in a refrigerant circuit for refrigeration, industrial cooling, freezing, air conditioning or other appropriate applications where compressed fluid is desired. Appropriate connection ports provide for connection to a refrigeration circuit and include a refrigerant inlet port 18 and a refrigerant outlet port 20 extending through the outer housing 12. The scroll compressor assembly 10 is operable through operation of the drive unit 16 to operate the scroll compressor 14 and thereby compress an appropriate refrigerant or other fluid that enters the refrigerant inlet port 18 and exits the refrigerant outlet port 20 in a compressed high-pressure state.

The outer housing for the scroll compressor assembly 10 may take many forms. In particular embodiments of the invention, the outer housing 12 includes multiple shell sections. In the embodiment of FIG. 1, the outer housing 12 includes a central cylindrical housing section 24, and a top end housing section 26, and a single-piece bottom shell 28 that serves as a mounting base. In certain embodiments, the housing sections 24, 26, 28 are formed of appropriate sheet steel and welded together to make a permanent outer housing 12 enclosure. However, if disassembly of the housing is desired, other housing assembly provisions can be made that can include metal castings or machined components, wherein the housing sections 24, 26, 28 are attached using fasteners.

As can be seen in the embodiment of FIG. 1, the central housing section 24 is cylindrical, joined with the top end housing section 26. In this embodiment, a separator plate 30 is disposed in the top end housing section 26. During assembly, these components can be assembled such that when the top end housing section 26 is joined to the central cylindrical housing section 24, a single weld around the circumference of the outer housing 12 joins the top end housing section 26, the separator plate 30, and the central cylindrical housing section 24. In particular embodiments, the central cylindrical housing section 24 is welded to the single-piece bottom shell 28, though, as stated above, alternate embodiments would include other methods of joining (e.g., fasteners) these sections of the outer housing 12. Assembly of the outer housing 12 results in the formation of an enclosed chamber 31 that surrounds the drive unit 16, and partially surrounds the scroll compressor 14. In particular embodiments, the top end housing section 26 is generally dome-shaped and includes a respective cylindrical side wall region 32 that abuts the top of the central cylindrical housing section 24, and provides for closing off the top end of the outer housing 12. As can also be seen from FIG. 1, the bottom of the central cylindrical housing section 24 abuts a flat portion just to the outside of a raised annular rib 34 of the bottom end housing section 28. In at least one embodiment of the invention, the central cylindrical housing section 24 and bottom end housing section 28 are joined by an exterior weld around the circumference of a bottom end of the outer housing 12.

In a particular embodiment, the drive unit 16 in is the form of an electrical motor assembly 40. The electrical motor assembly 40 operably rotates and drives a shaft 46. Further, the electrical motor assembly 40 generally includes a stator 50 comprising electrical coils and a rotor 52 that is coupled to the drive shaft 46 for rotation together. The stator 50 is supported by the outer housing 12, either directly or via an adapter. The stator 50 may be press-fit directly into outer housing 12, or may be fitted with an adapter (not shown) and press-fit into the outer housing 12. In a particular embodiment, the rotor 52 is mounted on the drive shaft 46, which is supported by upper and lower bearings 42, 44. Energizing the stator 50 is operative to rotatably drive the rotor 52 and thereby rotate the drive shaft 46 about a central axis 54. Applicant notes that when the terms "axial" and "radial" are used herein to describe features of components or assemblies, they are defined with respect to the central axis 54. Specifically, the term "axial" or "axially-extending" refers to a feature that projects or extends in a direction parallel to the central axis 54, while the terms "radial' or "radially-extending" indicates a feature that projects or extends in a direction perpendicular to the central axis 54.

With reference to FIG. 1, the lower bearing member 44 includes a central, generally cylindrical hub 58 that includes a central bushing and opening to provide a cylindrical bearing 60 to which the drive shaft 46 is journaled for rotational support. A plate-like ledge region 68 of the lower bearing member 44 projects radially outward from the central hub 58, and serves to separate a lower portion of the stator 50 from an oil lubricant sump 76. An axially-extending perimeter surface 70 of the lower bearing member 44 may engage with the inner diameter surface of the central housing section 24 to centrally locate the lower bearing member 44 and thereby maintain its position relative to the central axis 54. This can be by way of an interference and press-fit support arrangement between the lower bearing member 44 and the outer housing 12.

In the embodiment of FIG. 1, the drive shaft 46 has an impeller tube 47 attached at the bottom end of the drive shaft 46. In a particular embodiment, the impeller tube 47 is of a smaller diameter than the drive shaft 46, and is aligned concentrically with the central axis 54. As can be seen from FIG. 1, the drive shaft 46 and impeller tube 47 pass through an opening in the cylindrical hub 58 of the lower bearing member 44. At its upper end, the drive shaft 46 is journaled for rotation within the upper bearing member 42. Upper bearing member 42 may also be referred to as a "crankcase".

The drive shaft 46 further includes an offset eccentric drive section 74 that has a cylindrical drive surface 75 (shown in FIG. 2) about an offset axis that is offset relative to the central axis 54. This offset drive section 74 is journaled within a cavity of a movable scroll compressor body 112 of the scroll compressor 14 to drive the movable scroll compressor body 112 about an orbital path when the drive shaft 46 rotates about the central axis 54. To provide for lubrication of all of the various bearing surfaces, the outer housing 12 provides the oil lubricant sump 76 at the bottom end of the outer housing 12 in which suitable oil lubricant is provided. The impeller tube 47 has an oil lubricant passage and inlet port 78 formed at the end of the impeller tube 47. Together, the impeller tube 47 and inlet port 78 act as an oil pump when the drive shaft 46 is rotated, and thereby pumps oil out of the lubricant sump 76 into an internal lubricant passageway 80 defined within the drive shaft 46. During rotation of the drive shaft 46, centrifugal force acts to drive lubricant oil up through the lubricant passageway 80 against the action of gravity. The lubricant passageway 80 has various radial passages projecting therefrom to feed oil through centrifugal force to appropriate bearing surfaces and thereby lubricate sliding surfaces as may be desired.

Figure 2:
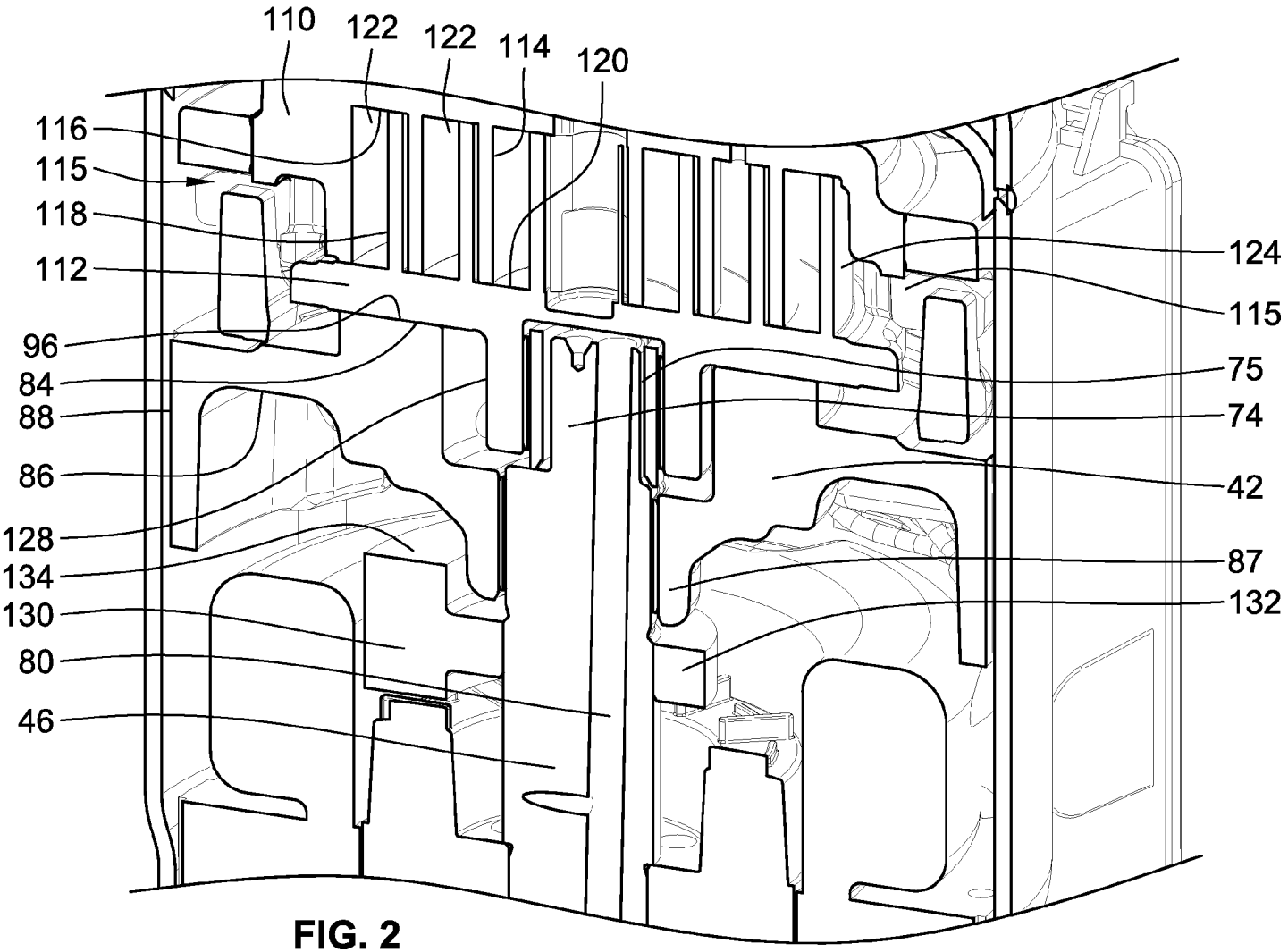
FIG. 2 is a cross-sectional isometric view of an upper portion of the scroll compressor assembly of FIG. 1.
Figure 3:
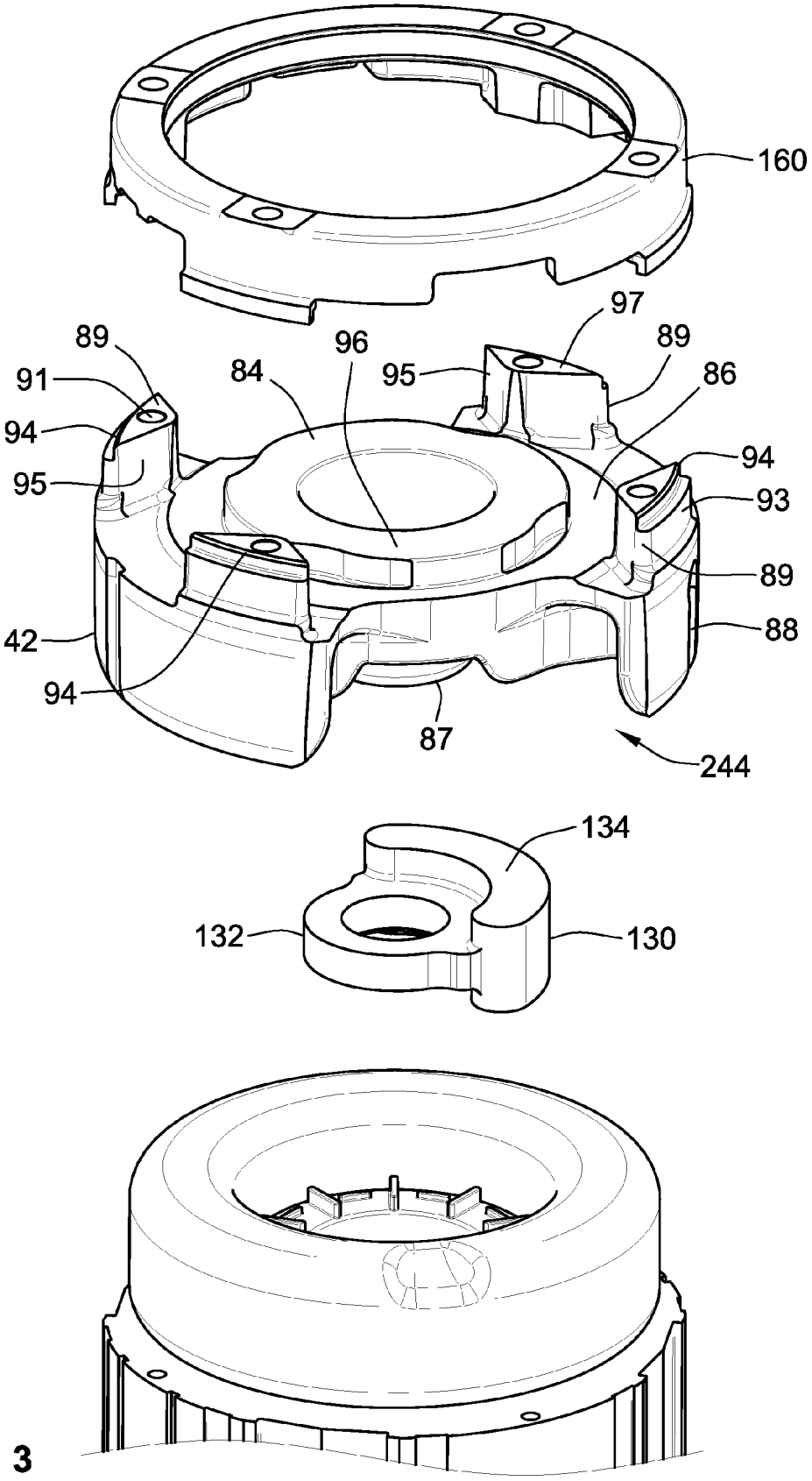
FIG. 3 is an exploded isometric view of selected components of the scroll compressor assembly of FIG. 1.

As shown in FIGS. 2 and 3, the upper bearing member, or crankcase, 42 includes a central bearing hub 87 into which the drive shaft 46 is journaled for rotation, and a thrust bearing 84 that supports the movable scroll compressor body 112. (See also FIG. 9). Extending outward from the central bearing hub 87 is a disk-like portion 86 that terminates in an intermittent perimeter support surface 88 defined by discretely spaced posts 89. In the embodiment of FIG. 3, the central bearing hub 87 extends below the disk-like portion 86, while the thrust bearing 84 extends above the disk-like portion 86. In certain embodiments, the intermittent perimeter support surface 88 is adapted to have an interference and press-fit with the outer housing 12. In the embodiment of FIG. 3, the crankcase 42 includes four posts 89, each post having an opening 91 configured to receive a threaded fastener. It is understood that alternate embodiments of the invention may include a crankcase with more or less than four posts, or the posts may be separate components altogether. Alternate embodiments of the invention also include those in which the posts are integral with the pilot ring instead of the crankcase.

In certain embodiments such as the one shown in FIG. 3, each post 89 has an arcuate outer surface 93 spaced radially inward from the inner surface of the outer housing 12, angled interior surfaces 95, and a generally flat top surface 97 which can support a pilot ring 160. In this embodiment, intermittent perimeter support surface 88 abuts the inner surface of the outer housing 12. Further, each post 89 has a chamfered edge 94 on a top, outer portion of the post 89. In particular embodiments, the crankcase 42 includes a plurality of spaces 244 between adjacent posts 89. In the embodiment shown, these spaces 244 are generally concave and the portion of the crankcase 42 bounded by these spaces 244 will not contact the inner surface of the outer housing 12.

Figure 13:
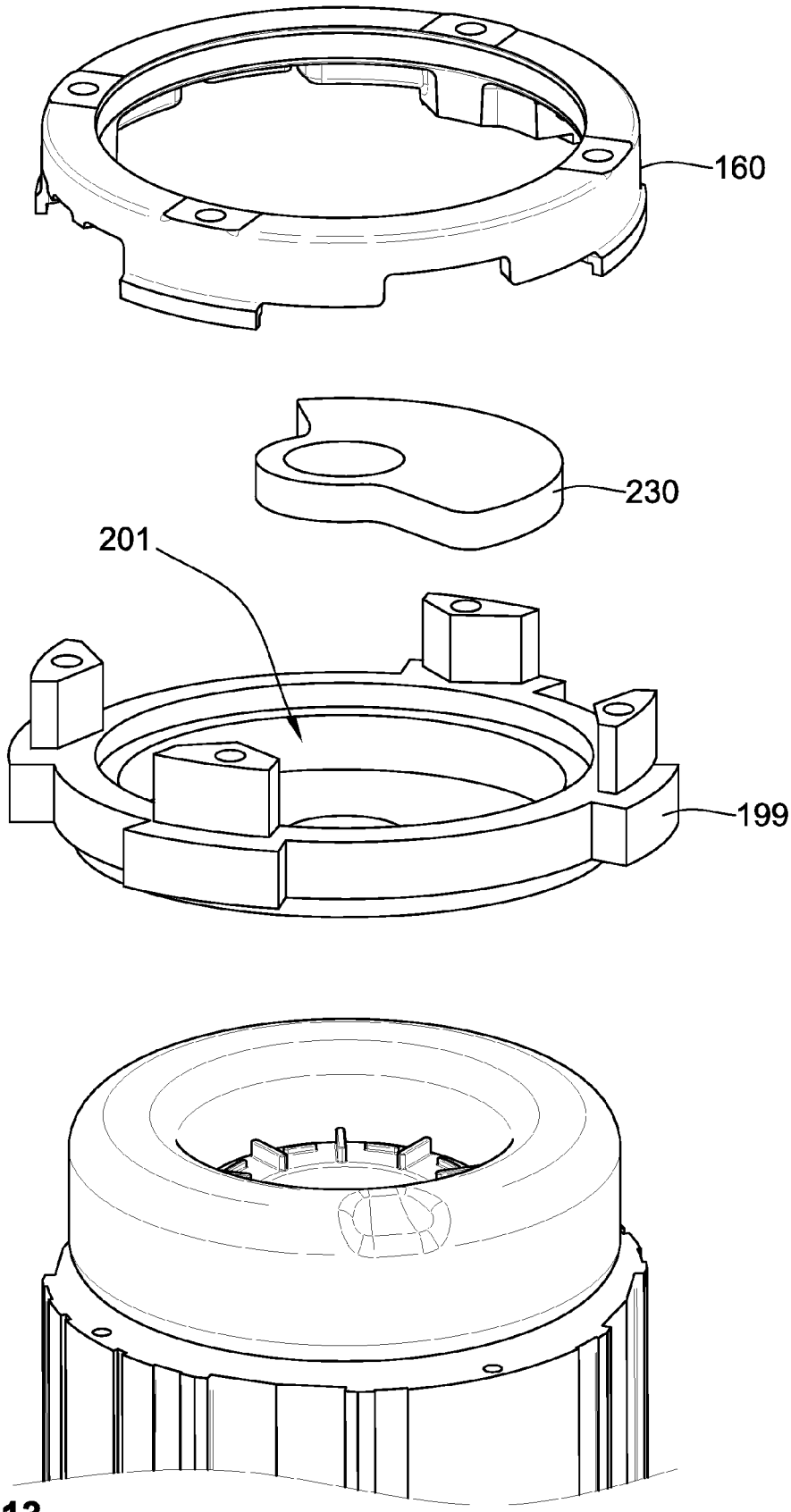
FIG. 13 is an exploded isometric view of selected components for an alternate embodiment of the scroll compressor assembly.
Figure 14:
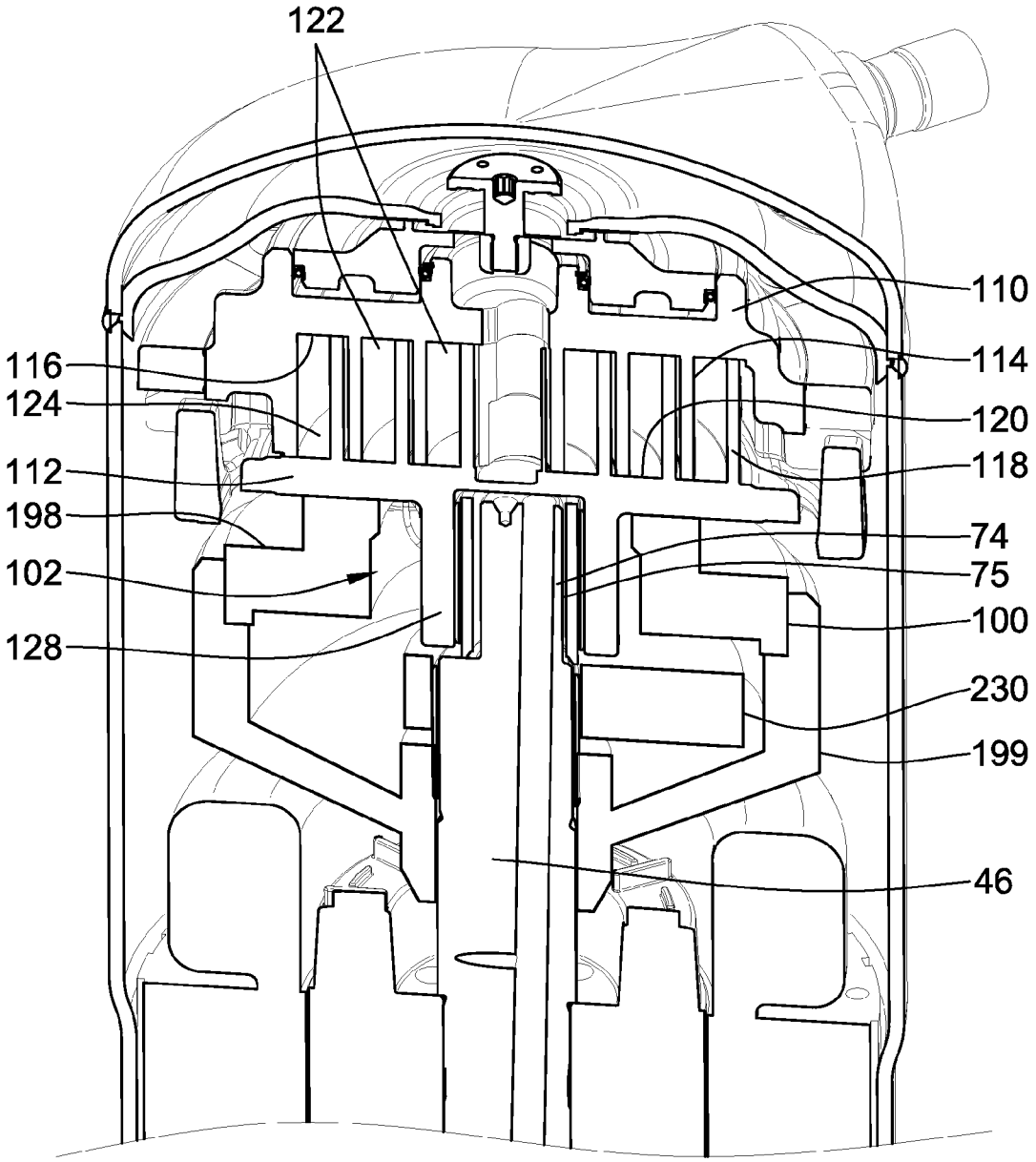
FIG. 14 is a cross-sectional isometric view of a portion of a scroll compressor assembly, constructed in accordance with an embodiment of the invention.

The upper bearing member or crankcase 42 also provides axial thrust support to the movable scroll compressor body 112 through a bearing support via an axial thrust surface 96 of thrust bearing 84. While, as shown FIGS. 1-3, the crankcase 42 may be integrally provided by a single unitary component, FIGS. 13 and 14 show an alternate embodiment in which the axial thrust support is provided by a separate collar member 198 that is assembled and concentrically located within the upper portion of the upper bearing member 199 along stepped annular interface 100. The collar member 198 defines a central opening 102 that is a size large enough to clear a cylindrical bushing drive hub 128 of the movable scroll compressor body 112 in addition to the eccentric offset drive section 74, and allow for orbital eccentric movement thereof.

Turning in greater detail to the scroll compressor 14, the scroll compressor includes first and second scroll compressor bodies which preferably include a stationary fixed scroll compressor body 110 and a movable scroll compressor body 112. While the term "fixed" generally means stationary or immovable in the context of this application, more specifically "fixed" refers to the non-orbiting, non-driven scroll member, as it is acknowledged that some limited range of axial, radial, and rotational movement is possible due to thermal expansion and/or design tolerances.

The movable scroll compressor body 112 is arranged for orbital movement relative to the fixed scroll compressor body 110 for the purpose of compressing refrigerant. The fixed scroll compressor body includes a first rib 114 projecting axially from a plate-like base 116 and is designed in the form of a spiral. Similarly, the movable scroll compressor body 112 includes a second scroll rib 118 projecting axially from a plate-like base 120 and is in the shape of a similar spiral. The scroll ribs 114, 118 engage in one another and abut sealingly on the respective surfaces of bases 120, 116 of the respectively other compressor body 112, 110. As a result, multiple compression chambers 122 are formed between the scroll ribs 114, 118 and the bases 120, 116 of the compressor bodies 112, 110. Within the chambers 122, progressive compression of refrigerant takes place. Refrigerant flows with an initial low pressure via an intake area 124 surrounding the scroll ribs 114, 118 in the outer radial region (see e.g. FIGS. 1-2). Following the progressive compression in the chambers 122 (as the chambers progressively are defined radially inward), the refrigerant exits via a compression outlet 126 which is defined centrally within the base 116 of the fixed scroll compressor body 110. Refrigerant that has been compressed to a high pressure can exit the chambers 122 via the compression outlet 126 during operation of the scroll compressor 14.

The movable scroll compressor body 112 engages the eccentric offset drive section 74 of the drive shaft 46. More specifically, the receiving portion of the movable scroll compressor body 112 includes the cylindrical bushing drive hub 128 which slideably receives the eccentric offset drive section 74 with a slideable bearing surface provided therein. In detail, the eccentric offset drive section 74 engages the cylindrical bushing drive hub 128 in order to move the movable scroll compressor body 112 about an orbital path about the central axis 54 during rotation of the drive shaft 46 about the central axis 54. Considering that this offset relationship causes a weight imbalance relative to the central axis 54, the assembly typically includes a counterweight 130 that is mounted at a fixed angular orientation to the drive shaft 46. The counterweight 130 acts to offset the weight imbalance caused by the eccentric offset drive section 74 and the movable scroll compressor body 112 that is driven about an orbital path. The counterweight 130 includes an attachment collar 132 and an offset weight region 134 (see counterweight 130 shown best in FIGS. 2 and 3) that provides for the counterweight effect and thereby balancing of the overall weight of the components rotating about the central axis 54. This provides for reduced vibration and noise of the overall assembly by internally balancing or cancelling out inertial forces.

Figure 4:
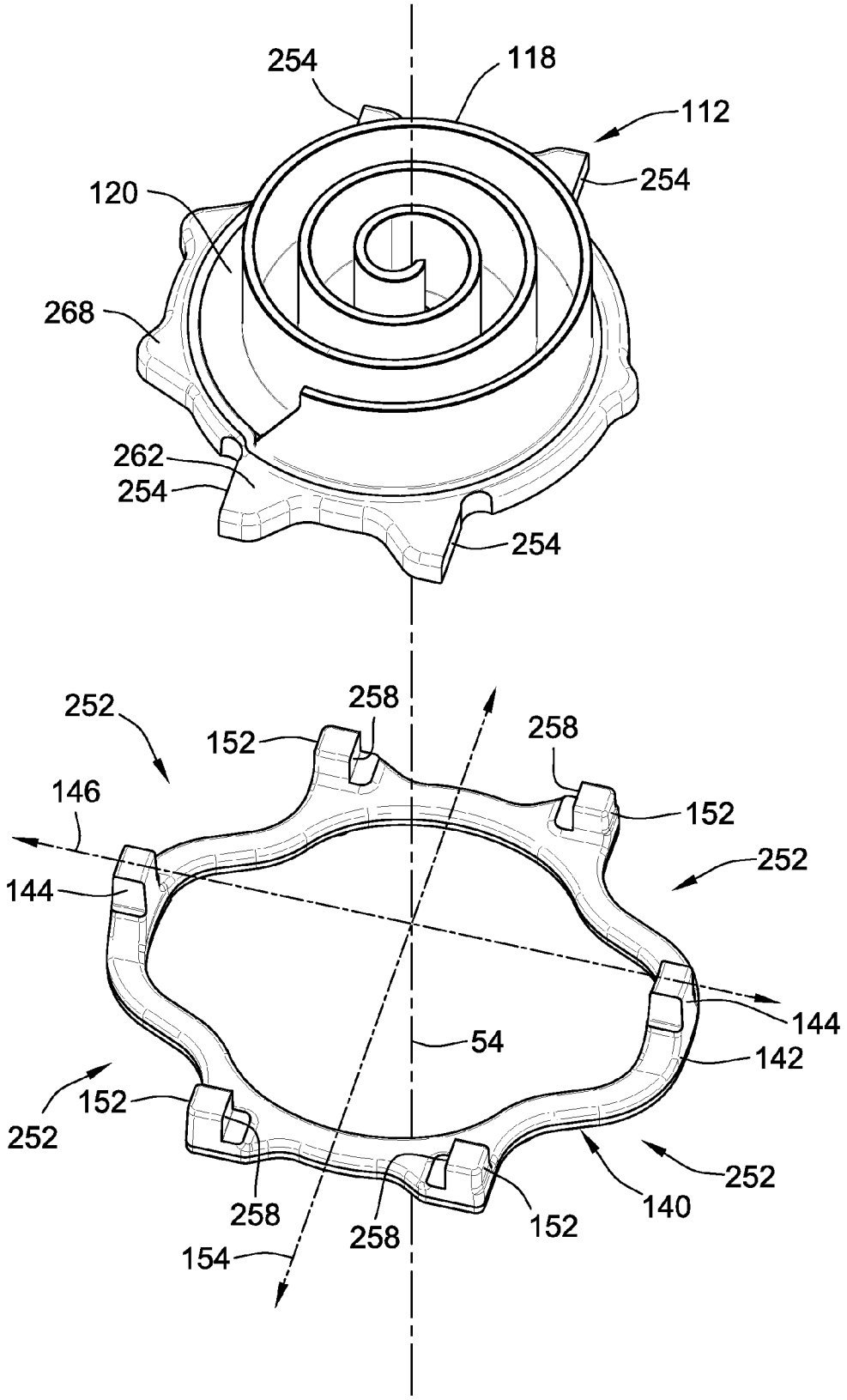
FIG. 4 is a perspective view of an exemplary key coupling and movable scroll compressor body, according to an embodiment of the invention.
Figure 7:
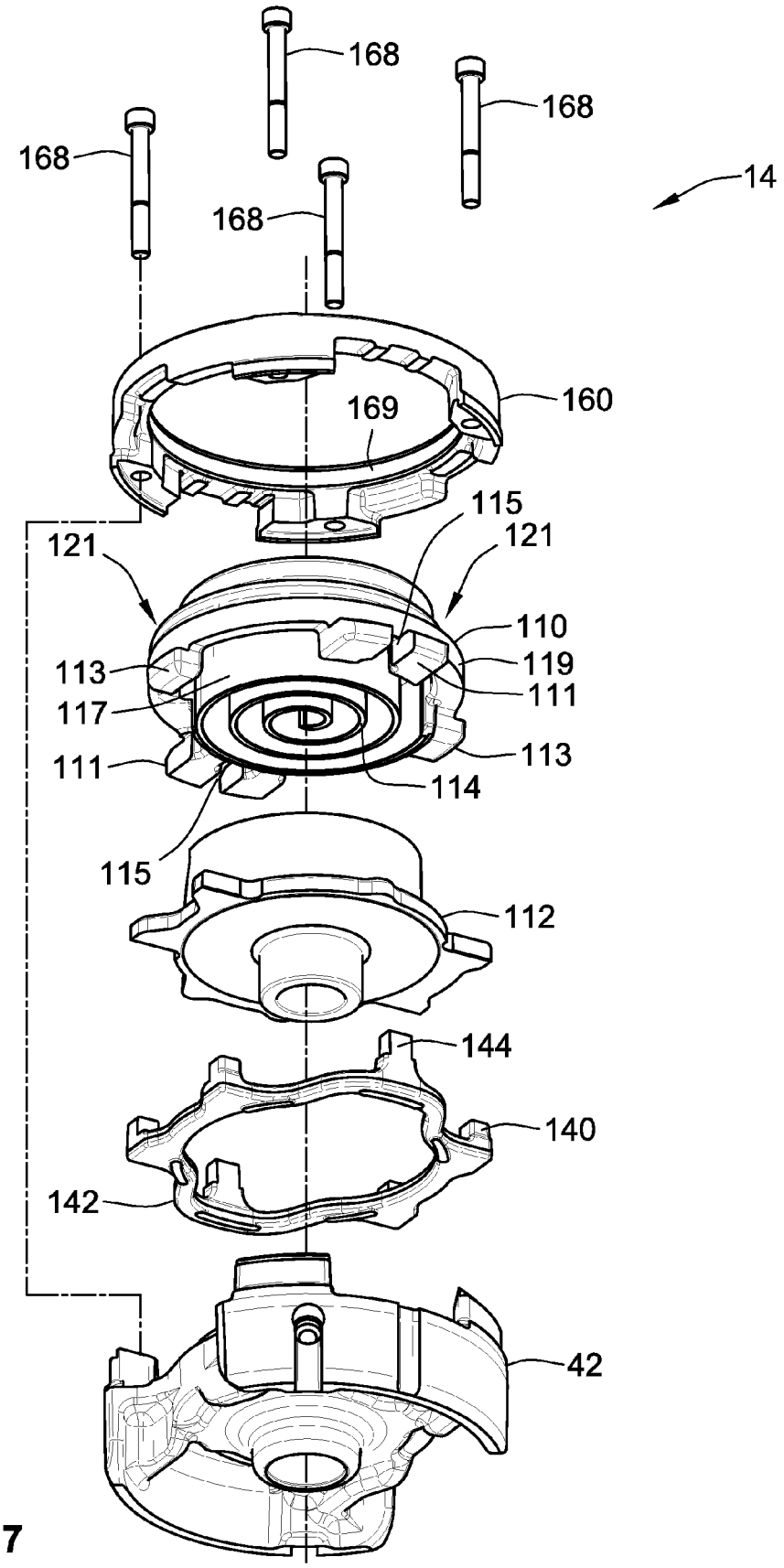
FIG. 7 is an exploded isometric view of the pilot ring, crankcase, key coupler and scroll compressor bodies, according to an embodiment of the invention.

With reference to FIGS. 4 and 7, the guiding movement of the scroll compressor 14 can be seen. To guide the orbital movement of the movable scroll compressor body 112 relative to the fixed scroll compressor body 110, an appropriate key coupling 140 may be provided. Keyed couplings 140 are often referred to in the scroll compressor art as an "Oldham Coupling." In this embodiment, the key coupling 140 includes an outer ring body 142 and includes two axially-projecting first keys 144 that are linearly spaced along a first lateral axis 146 and that slide closely and linearly within two respective keyway tracks or slots 115 (shown in FIGS. 1 and 2) of the fixed scroll compressor body 110 that are linearly spaced and aligned along the first axis 146 as well. The slots 115 are defined by the stationary fixed scroll compressor body 110 such that the linear movement of the key coupling 140 along the first lateral axis 146 is a linear movement relative to the outer housing 12 and perpendicular to the central axis 54. The keys can comprise slots, grooves or, as shown, projections which project axially (i.e., parallel to central axis 54) from the ring body 142 of the key coupling 140. This control of movement along the first lateral axis 146 guides part of the overall orbital path of the movable scroll compressor body 112.

Referring specifically to FIG. 4, the key coupling 140 includes four axially-projecting second keys 152 in which opposed pairs of the second keys 152 are linearly aligned substantially parallel relative to a second transverse lateral axis 154 that is perpendicular to the first lateral axis 146. There are two sets of the second keys 152 that act cooperatively to receive projecting sliding guide portions 254 that project from the base 120 on opposite sides of the movable scroll compressor body 112. The guide portions 254 linearly engage and are guided for linear movement along the second transverse lateral axis by virtue of sliding linear guiding movement of the guide portions 254 along sets of the second keys 152.

It can be seen in FIG. 4 that four sliding contact surfaces 258 are provided on the four axially-projecting second keys 152 of the key coupling 140. As shown, each of the sliding contact surfaces 258 is contained in its own separate quadrant 252 (the quadrants 252 being defined by the mutually perpendicular lateral axes 146, 154). As shown, cooperating pairs of the sliding contact surfaces 258 are provided on each side of the first lateral axis 146.

By virtue of the key coupling 140, the movable scroll compressor body 112 has movement restrained relative to the fixed scroll compressor body 110 along the first lateral axis 146 and second transverse lateral axis 154. This results in the prevention of relative rotation of the movable scroll body as it allows only translational motion. More particularly, the fixed scroll compressor body 110 limits motion of the key coupling 140 to linear movement along the first lateral axis 146; and in turn, the key coupling 140 when moving along the first lateral axis 146 carries the movable scroll 112 along the first lateral axis 146 therewith. Additionally, the movable scroll compressor body can independently move relative to the key coupling 140 along the second transverse lateral axis 154 by virtue of relative sliding movement afforded by the guide portions 254 which are received and slide between the second keys 152. By allowing for simultaneous movement in two mutually perpendicular axes 146, 154, the eccentric motion that is afforded by the eccentric offset drive section 74 of the drive shaft 46 upon the cylindrical bushing drive hub 128 of the movable scroll compressor body 112 is translated into an orbital path movement of the movable scroll compressor body 112 relative to the fixed scroll compressor body 110.

To carry axial thrust loads, the movable scroll compressor body 112 also includes flange portions 268 projecting in a direction perpendicular relative to the guiding flange portions 262 (e.g. along the first lateral axis 146). These additional flange portions 268 are preferably contained within the diametrical boundary created by the guide flange portions 262 so as to best realize the size reduction benefits. Yet a further advantage of this design is that the sliding faces 254 of the movable scroll compressor body 112 are open and not contained within a slot. This is advantageous during manufacture in that it affords subsequent machining operations such as finishing milling for creating the desirable tolerances and running clearances as may be desired.

Figure 5:
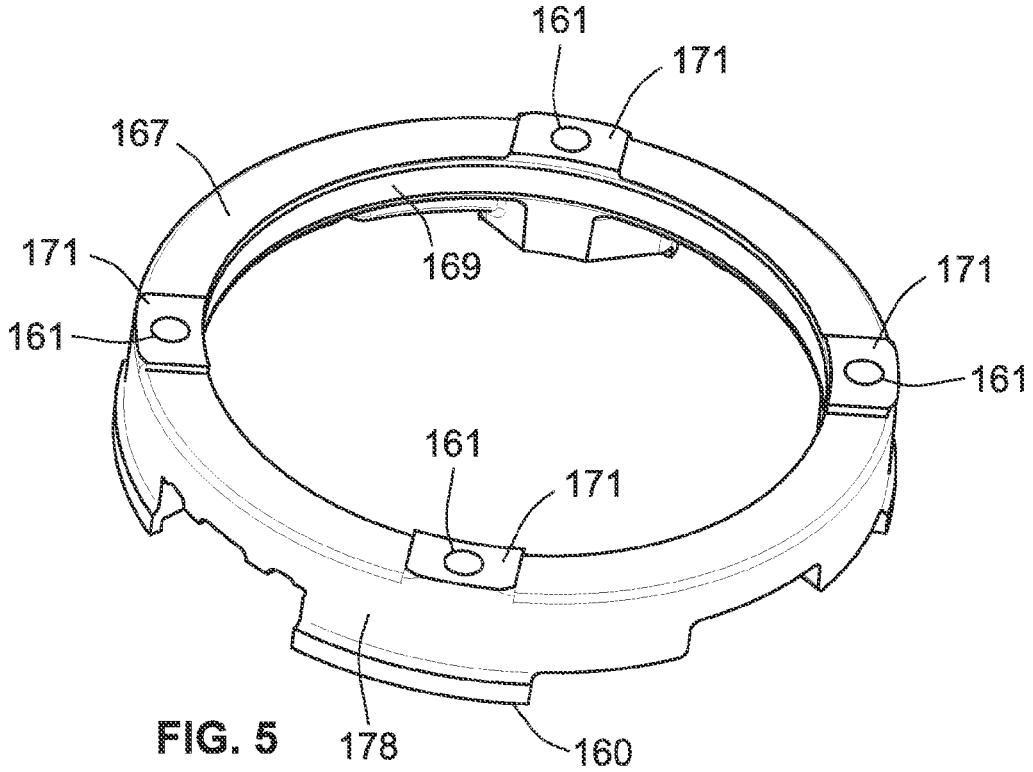
FIG. 5 is a top isometric view of the pilot ring, constructed in accordance with an embodiment of the invention.

Generally, scroll compressors with movable and fixed scroll compressor bodies require some type of restraint for the fixed scroll compressor body 110 which restricts the radial movement and rotational movement but which allows some degree of axial movement so that the fixed and movable scroll compressor bodies 110, 112 are not damaged during operation of the scroll compressor 14. In embodiments of the invention, that restraint is provided by a pilot ring 160, as shown in FIGS. 5-9. FIG. 5 shows the top side of pilot ring 160, constructed in accordance with an embodiment of the invention. The pilot ring 160 has a top surface 167, a cylindrical outer perimeter surface 178, and a cylindrical first inner wall 169. The pilot ring 160 of FIG. 5 includes four holes 161 through which fasteners, such as threaded bolts, may be inserted to allow for attachment of the pilot ring 160 to the crankcase 42. In a particular embodiment, the pilot ring 160 has axially-raised portions 171 (also referred to as mounting bosses) where the holes 161 are located. One of skill in the art will recognize that alternate embodiments of the pilot ring may have greater or fewer than four holes for fasteners. The pilot ring 160 may be a machined metal casting, or, in alternate embodiments, a machined component of iron, steel, aluminum, or some other similarly suitable material.

Figure 6:
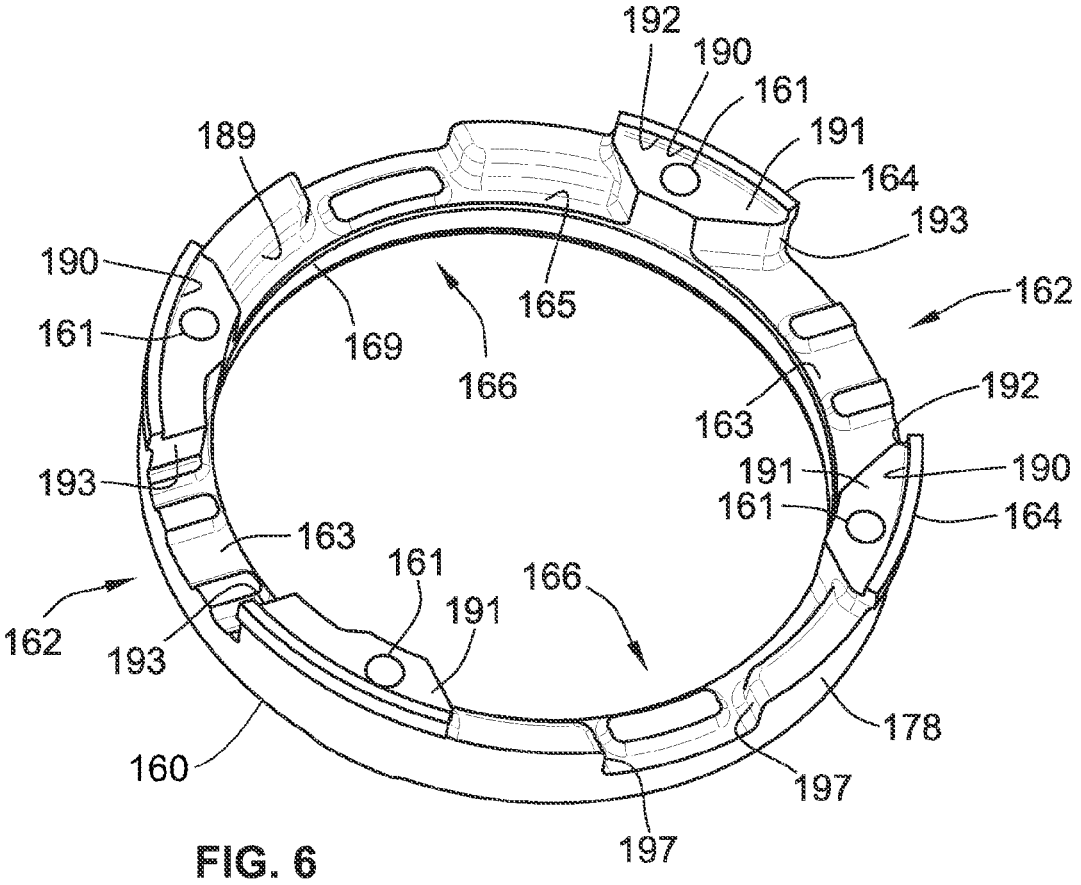
FIG. 6 is a bottom isometric view of the pilot ring of FIG. 5.

FIG. 6 shows a bottom view of the pilot ring 160 showing the four holes 161 along with two slots 162 formed into the pilot ring 160. In the embodiment of FIG. 6, the slots 162 are spaced approximately 180 degrees apart on the pilot ring 160. Each slot 162 is bounded on two sides by axially-extending side walls 193. As shown in FIG. 6, the bottom side of the pilot ring 160 includes a base portion 163 which is continuous around the entire circumference of the pilot ring 160 forming a complete cylinder. But on each side of the two slots 162, there is a semi-circular stepped portion 164 which covers some of the base portion 163 such that a ledge 165 is formed on the part of the pilot ring 160 radially inward of each semi-circular stepped portion 164. The inner-most diameter or the ledge 165 is bounded by the first inner wall 169.

A second inner wall 189 runs along the inner diameter of each semi-circular stepped portion 164. Each semi-circular stepped portion 164 further includes a bottom surface 191, a notched section 166, and a chamfered lip 190. In the embodiment of FIG. 6, each chamfered lip 190 runs the entire length of the semi-circular stepped portion 164 making the chamfered lip 190 semi-circular as well. Each chamfered lip 190 is located on the radially-outermost edge of the bottom surface 191, and extends axially from the bottom surface 191. Further, each chamfered lip 190 includes a chamfered edge surface 192 on an inner radius of the chamfered lip 190. When assembled, the chamfered edge surface 192 is configured to mate with the chamfered edge 94 on each post 89 of the crankcase. The mating of these chamfered surfaces allows for an easier, better-fitting assembly, and reduces the likelihood of assembly problems due to manufacturing tolerances.

In the embodiment of FIG. 6, the notched sections 166 are approximately 180 degrees apart on the pilot ring 160, and each is about midway between the two ends of the semi-circular stepped portion 164. The notched sections 166 are bounded on the sides by sidewall sections 197. Notched sections 166 thus extend radially and axially into the semi-circular stepped portion 164 of the pilot ring 160.

FIG. 7 shows an exploded view of the scroll compressor 14 assembly, according to an embodiment of the invention. The top-most component shown is the pilot ring 160 which is adapted to fit over the top of the fixed scroll compressor body 110. The fixed scroll compressor body 110 has a pair of first radially-outward projecting limit tabs 111. In the embodiment of FIG. 7, one of the pair of first radially-outward projecting limit tabs 111 is attached to an outermost perimeter surface 117 of the first scroll rib 114, while the other of the pair of first radially-outward projecting limit tabs 111 is attached to a perimeter portion of the fixed scroll compressor body 110 below a perimeter surface 119. In further embodiments, the pair of first radially-outward projecting limit tabs 111 are spaced approximately 180 degrees apart. Additionally, in particular embodiments, each of the pair of first radially-outward-projecting limit tabs 111 has a slot 115 therein. In particular embodiments, the slot 115 may be a U-shaped opening, a rectangular-shaped opening, or have some other suitable shape.

The fixed scroll compressor body 110 also has a pair of second radially-outward projecting limit tabs 113, which, in this embodiment, are spaced approximately 180 degrees apart. In certain embodiments, the second radially-outward projecting limit tabs 113 share a common plane with the first radially-outward-projecting limit tabs 111. Additionally, in the embodiment of FIG. 7, one of the pair of second radially-outward projecting limit tabs 113 is attached to an outermost perimeter surface 117 of the first scroll rib 114, while the other of the pair of second radially-outward projecting limit tabs 113 is attached to a perimeter portion of the fixed scroll compressor body 110 below the perimeter surface 119. The movable scroll compressor body 112 is configured to be held within the keys of the key coupling 140 and mates with the fixed scroll compressor body 110. As explained above, the key coupling 140 has two axially-projecting first keys 144, which are configured to be received within the slots 115 in the first radially-outward-projecting limit tabs 111. When assembled, the key coupling 140, fixed and movable scroll compressor bodies 110, 112 are all configured to be disposed within crankcase 42, which can be attached the to the pilot ring 160 by the threaded bolts 168 shown above the pilot ring 160.

Referring still to FIG. 7, the fixed scroll compressor body 110 includes plate-like base 116 (see FIG. 14) and the perimeter surface 119 spaced axially from the plate-like base 116. In a particular embodiment, the entirety of the perimeter surface 119 surrounds the first scroll rib 114 of the fixed scroll compressor body 110, and is configured to abut the first inner wall 169 of the pilot ring 160, though embodiments are contemplated in which the engagement of the pilot ring and fixed scroll compressor body involve less than the entire circumference. In particular embodiments of the invention, the first inner wall 169 is precisely toleranced to fit snugly around the perimeter surface 119 to thereby limit radial movement of the first scroll compressor body 110, and thus provide radial restraint for the first scroll compressor body 110. The plate-like base 116 further includes a radially-extending top surface 121 that extends radially inward from the perimeter surface 119. The radially-extending top surface 121 extends radially inward towards a step-shaped portion 123 (see FIG. 8). From this step-shaped portion 123, a cylindrical inner hub region 172 and peripheral rim 174 extend axially (i.e., parallel to central axis 54, when assembled into scroll compressor assembly 10).

Figure 8:
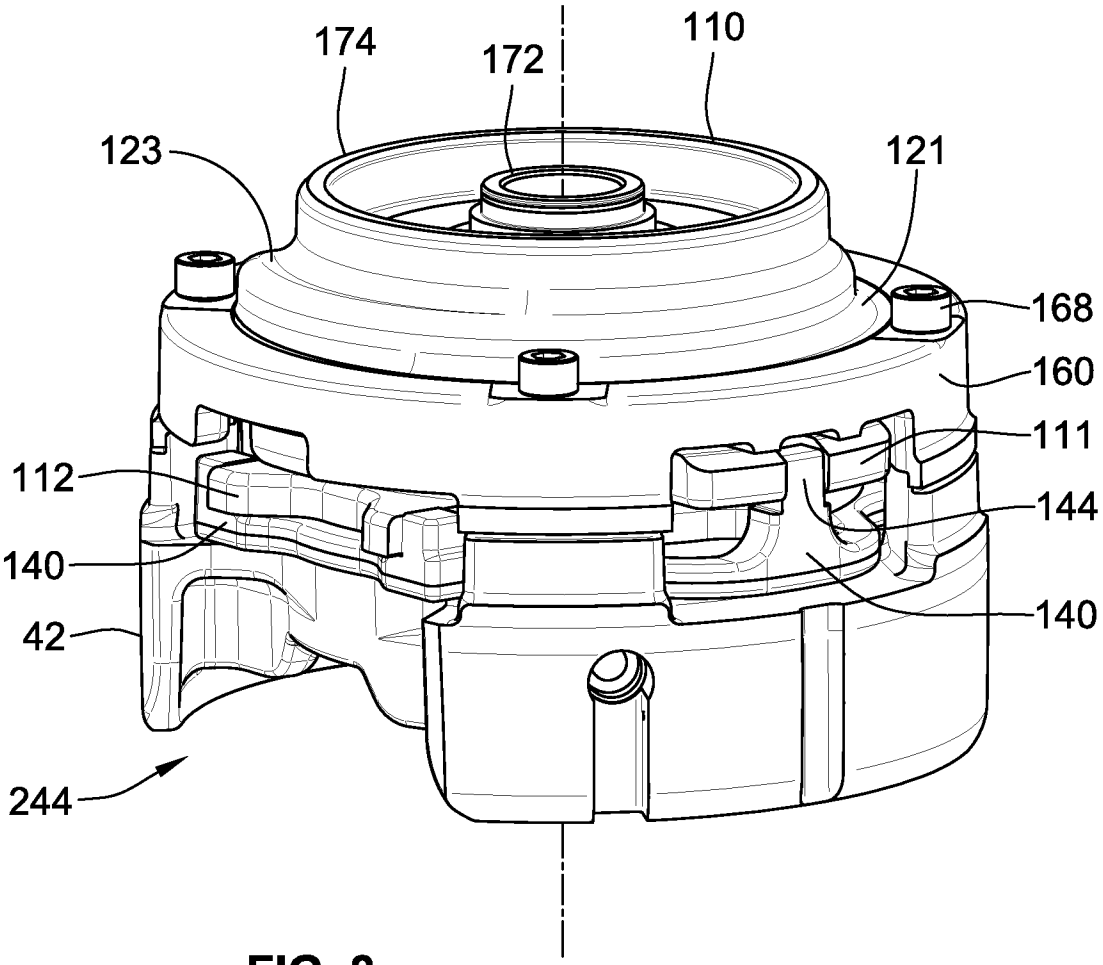
FIG. 8 is a isometric view of the components of FIG. 7 shown assembled.

FIG. 8 shows the components of FIG. 7 fully assembled. The pilot ring 160 securely holds the fixed scroll compressor body 110 in place with respect to the movable scroll compressor body 112 and key coupling 140. The threaded bolts 168 attach the pilot ring 160 and crankcase 42. As can be seen from FIG. 8, each of the pair of first radially-outward projecting limit tabs 111 is positioned in its respective slot 162 of the pilot ring 160. As stated above, the slots 115 in the pair of first radially-outward projecting limit tabs 111 are configured to receive the two axially-projecting first keys 144. In this manner, the pair of first radially-outward projecting limit tabs 111 engage the side portion 193 of the pilot ring slots 162 to prevent rotation of the fixed scroll compressor body 110, while the key coupling first keys 144 engage a side portion of the slot 115 to prevent rotations of the key coupling 140. Limit tabs 111 also provide additional (to limit tabs 113) axial limit stops.

Though not visible in the view of FIG. 8, each of the pair of second radially-outward projecting limit tabs 113 (see FIG. 7) is nested in its respective notched section 166 of the pilot ring 160 to constrain axial movement of the fixed scroll compressor body 110 thereby defining a limit to the available range of axial movement of the fixed scroll compressor body 110. The pilot ring notched sections 166 are configured to provide some clearance between the pilot ring 160 and the pair of second radially-outward projecting limit tabs 113 to provide for axial restraint between the fixed and movable scroll compressor bodies 110, 112 during scroll compressor operation. However, the radially-outward projecting limit tabs 113 and notched sections 166 also keep the extent of axial movement of the fixed scroll compressor body 110 to within an acceptable range.

It should be noted that "limit tab" is used generically to refer to either or both of the radially-outward projecting limit tabs 111, 113. Embodiments of the invention may include just one of the pairs of the radially-outward projecting limit tabs, or possibly just one radially-outward projecting limit tab, and particular claims herein may encompass these various alternative embodiments As illustrated in FIG. 8, the crankcase 42 and pilot ring 160 design allow for the key coupling 140, and the fixed and movable scroll compressor bodies 110, 112 to be of a diameter that is approximately equal to that of the crankcase 42 and pilot ring 160. As shown in FIG. 1, the diameters of these components may abut or nearly abut the inner surface of the outer housing 12, and, as such, the diameters of these components is approximately equal to the inner diameter of the outer housing 12. It is also evident that when the key coupling 140 is as large as the surrounding compressor outer housing 12 allows, this in turn provides more room inside the key coupling 140 for a larger thrust bearing which in turn allows a larger scroll set. This maximizes the scroll compressor 14 displacement available within a given diameter outer housing 12, and thus uses less material at less cost than in conventional scroll compressor designs.

It is contemplated that the embodiments of FIGS. 7 and 8 in which the first scroll compressor body 110 includes four radially-outward projecting limit tabs 111, 113, these limit tabs 111, 113 could provide radial restraint of the first scroll compressor body 110, as well as axial and rotation restraint. For example, radially-outward projecting limit tabs 113 could be configured to fit snugly with notched sections 166 such that these limit tabs 113 sufficiently limit radial movement of the first scroll compressor body 110 along first lateral axis 146. Additionally, each of the radially-outward-projecting limit tabs 111 could have a notched portion configured to abut the portion of the first inner wall 169 adjacent the slots 162 of the pilot ring 160 to provide radial restraint along second lateral axis 154. While this approach could potentially require maintaining a certain tolerance for the limit tabs 111, 113 or the notched section 166 and slots 162, in these instances, there would be no need to precisely tolerance the entire first inner wall 169 of the pilot ring 160, as this particular feature would not be needed to provide radial restraint of the first scroll compressor body 110.

Figure 11:
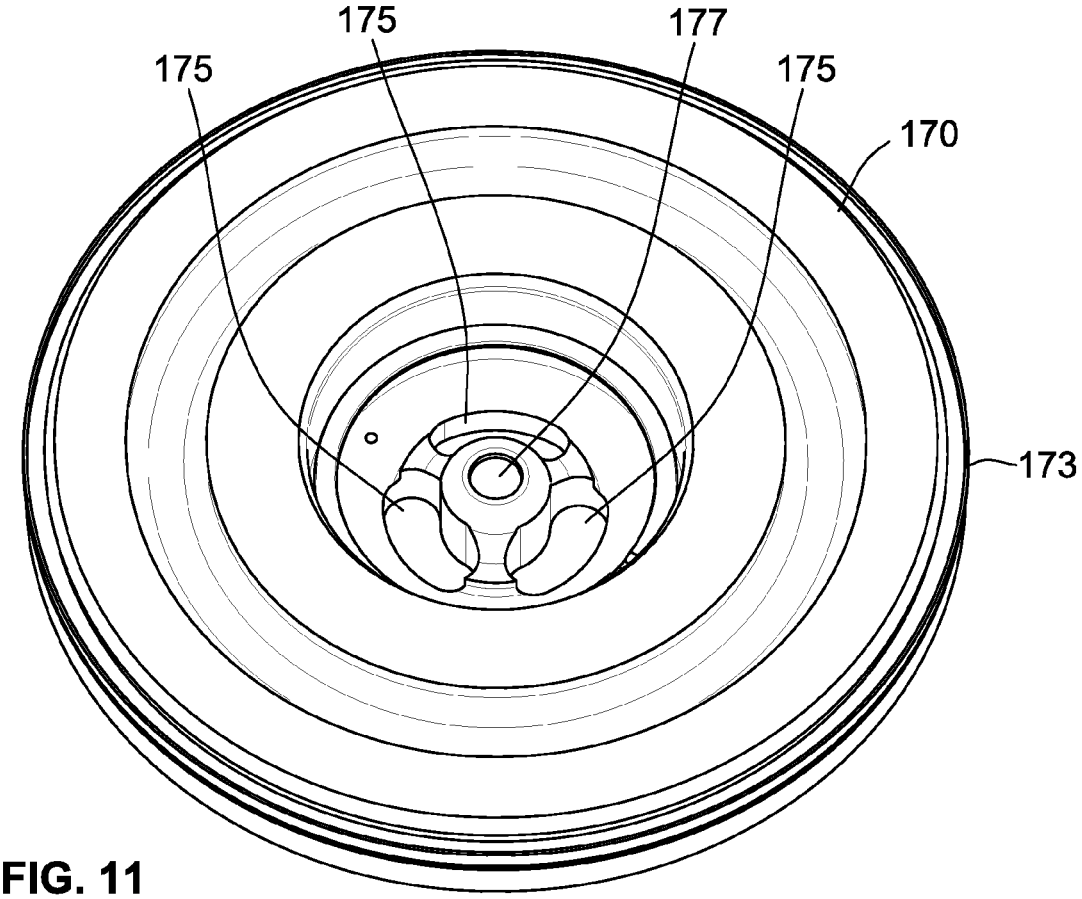
FIG. 11 is a bottom isometric view of the floating seal, according to an embodiment of the invention.
Figure 12:
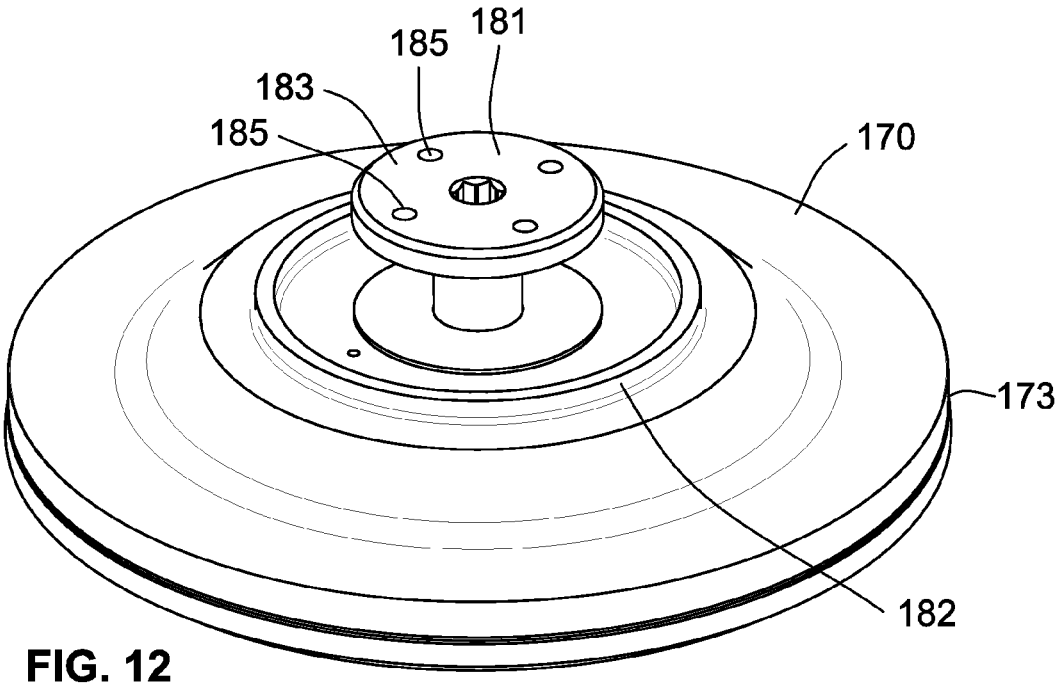
FIG. 12 is a top isometric view of the floating seal of FIG. 11.

With reference to FIGS. 9-12, the upper side (e.g. the side opposite the scroll rib) of the fixed scroll 110 supports a floating seal 170 above which is disposed the separator plate 30. In the embodiment shown, to accommodate the floating seal 170, the upper side of the fixed scroll compressor body 110 includes an annular and, more specifically, the cylindrical inner hub region 172, and the peripheral rim 174 spaced radially outward from the inner hub region 172. The inner hub region 172 and the peripheral rim 174 are connected by a radially-extending disc region 176 of the base 116. As shown in FIG. 11, the underside of the floating seal 170 has circular cutout adapted to accommodate the inner hub region 172 of the fixed scroll compressor body 110. Further, as can be seen from FIGS. 9 and 10, the perimeter wall 173 of the floating seal is adapted to fit somewhat snugly inside the peripheral rim 174. In this manner, the fixed scroll compressor body 110 centers and holds the floating seal 170 with respect to the central axis 54.

Figure 9:
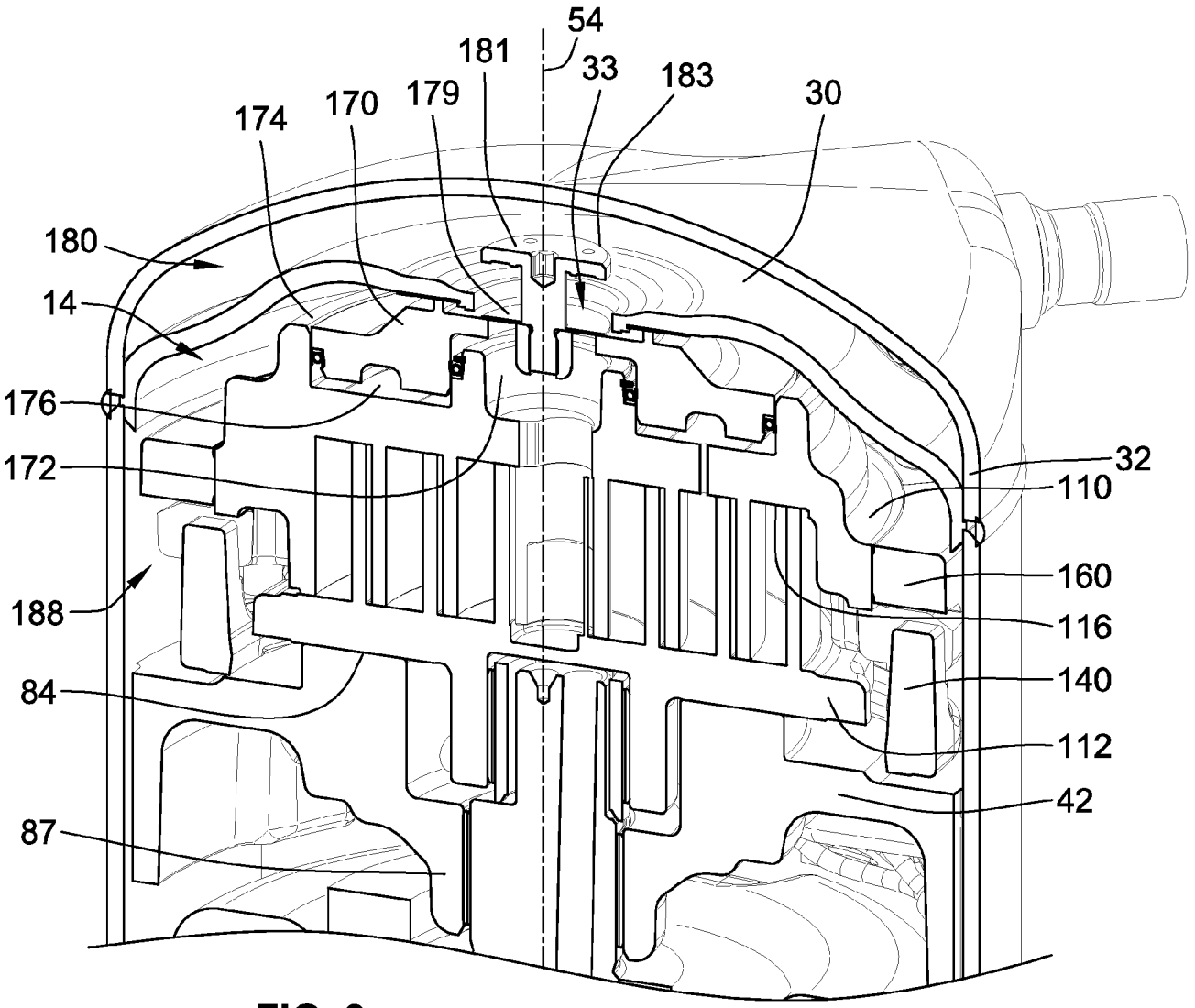
FIG. 9 is a cross-sectional isometric view of the components in the top end section of the outer housing, according to an embodiment of the invention.
Figure 10:
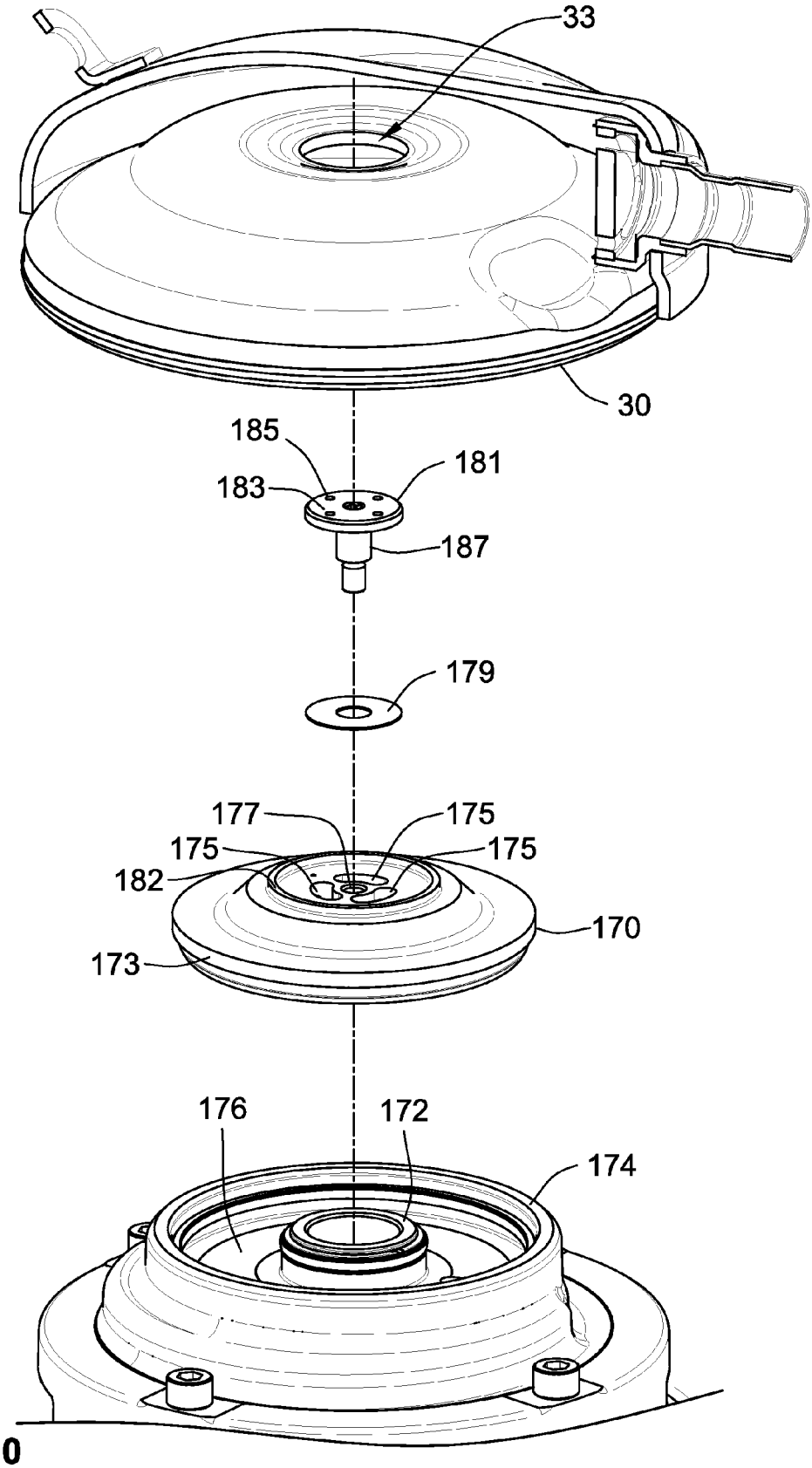
FIG. 10 is an exploded isometric view of the components of FIG. 9.

In a particular embodiment of the invention, a central region of the floating seal 170 includes a plurality of openings 175. In the embodiment shown, one of the plurality of openings 175 is centered on the central axis 54. That central opening 177 is adapted to receive a rod 181 which is affixed to the floating seal 170. As shown in FIGS. 9 through 12, a ring valve 179 is assembled to the floating seal 170 such that the ring valve 179 covers the plurality of openings 175 in the floating seal 170, except for the central opening 177 through which the rod 181 is inserted. The rod 181 includes an upper flange 183 with a plurality of openings 185 therethrough, and a stem 187. As can be seen in FIG. 9, the separator plate 30 has a center hole 33. The upper flange 183 of rod 181 is adapted to pass through the center hole 33, while the stem 187 is inserted through central opening 177. The ring valve 179 slides up and down the rod 181 as needed to prevent back flow from a high-pressure chamber 180. With this arrangement, the combination of the separator plate 30 and the fixed scroll compressor body 110 serve to separate the high pressure chamber 180 from a lower pressure region 188 within the outer housing 12. Rod 181 guides and limits the motion of the ring valve 179. While the separator plate 30 is shown as engaging and constrained radially within the cylindrical side wall region 32 of the top end housing section 26, the separator plate 30 could alternatively be cylindrically located and axially supported by some portion or component of the scroll compressor 14.

In certain embodiments, when the floating seal 170 is installed in the space between the inner hub region 172 and the peripheral rim 174, the space beneath the floating seal 170 is pressurized by a vent hole (not shown) drilled through the fixed scroll compressor body 110 to chamber 122 (shown in FIG. 2). This pushes the floating seal 170 up against the separator plate 30 (shown in FIG. 9). A circular rib 182 presses against the underside of the separator plate 30 forming a seal between high-pressure discharge gas and low-pressure suction gas.

While the separator plate 30 could be a stamped steel component, it could also be constructed as a cast and/or machined member (and may be made from steel or aluminum) to provide the ability and structural features necessary to operate in proximity to the high-pressure refrigerant gases output by the scroll compressor 14. By casting or machining the separator plate 30 in this manner, heavy stamping of such components can be avoided.

During operation, the scroll compressor assembly 10 is operable to receive low-pressure refrigerant at the housing inlet port 18 and compress the refrigerant for delivery to the high-pressure chamber 180 where it can be output through the housing outlet port 20. This allows the low-pressure refrigerant to flow across the electrical motor assembly 40 and thereby cool and carry away from the electrical motor assembly 40 heat which can be generated by operation of the motor. Low-pressure refrigerant can then pass longitudinally through the electrical motor assembly 40, around and through void spaces therein toward the scroll compressor 14. The low-pressure refrigerant fills the chamber 31 formed between the electrical motor assembly 40 and the outer housing 12. From the chamber 31, the low-pressure refrigerant can pass through the upper bearing member or crankcase 42 through the plurality of spaces 244 that are defined by recesses around the circumference of the crankcase 42 in order to create gaps between the crankcase 42 and the outer housing 12. The plurality of spaces 244 may be angularly spaced relative to the circumference of the crankcase 42.

After passing through the plurality of spaces 244 in the crankcase 42, the low-pressure refrigerant then enters the intake area 124 between the fixed and movable scroll compressor bodies 110, 112. From the intake area 124, the low-pressure refrigerant enters between the scroll ribs 114, 118 on opposite sides (one intake on each side of the fixed scroll compressor body 110) and is progressively compressed through chambers 122 until the refrigerant reaches its maximum compressed state at the compression outlet 126 from which it subsequently passes through the floating seal 170 via the plurality of openings 175 and into the high-pressure chamber 180. From this high-pressure chamber 180, high-pressure compressed refrigerant then flows from the scroll compressor assembly 10 through the housing outlet port 20.

FIGS. 13 and 14 illustrate an alternate embodiment of the invention. Instead of a crankcase 42 formed as a single piece, FIGS. 13 and 14 show an upper bearing member or crankcase 199 combined with a separate collar member 198, which provides axial thrust support for the scroll compressor 14. In a particular embodiment, the collar member 198 is assembled into the upper portion of the upper bearing member or crankcase 199 along stepped annular interface 100. Having a separate collar member 198 allows for a counterweight 230 to be assembled within the crankcase 199, which is attached to the pilot ring 160. This allows for a more compact assembly than described in the previous embodiment where the counterweight 130 was located outside of the crankcase 42.

As is evident from the exploded view of FIG. 13 and as stated above, the pilot ring 160 can be attached to the upper bearing member or crankcase 199 via a plurality of threaded fasteners to the upper bearing member 199 in the same manner that it was attached to crankcase 42 in the previous embodiment. The flattened profile of the counterweight 230 allows for it to be nested within an interior portion 201 of the upper bearing member 199 without interfering with the collar member 198, the key coupling 140, or the movable scroll compressor body 112.

All references, including publications, patent applications, and patents cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of compressing fluid in a scroll compressor, comprising:

providing first and second scroll compressor bodies having respective bases and respective scroll ribs that project from the respective bases, wherein the scroll ribs mutually engage, the second scroll body being movable relative to the first scroll body for compressing fluid, the first scroll body including a plurality of radially-outward-projecting limit tabs; and limiting movement of the first scroll body in the radial, axial, and rotational directions with a pilot ring configured to engage the plurality of radially-outward-projecting limit tabs, wherein limiting the movement of the first scroll body in the rotational direction comprises configuring the pilot ring with one or more slots, each slot adapted to receive a radially-outward-projecting limit tab on the first scroll body.

2. The method of claim 1, further comprising removably attaching the pilot ring to a crankcase such that the first and second scroll bodies are disposed within the attached pilot and crankcase.

3. The method of claim 2, further comprising assembling a key coupling to a base of the second scroll body to guide the movement thereof, the key coupling configured to engage at least one of the plurality of radially-outward-projecting limit tabs.

4. The method of claim 1, wherein limiting the movement of the first scroll body in the axial direction comprises configuring the pilot ring with one or more notches formed into a bottom surface of the pilot ring, each notch configured to receive a radially-outward-projecting limit tab on the first scroll body.

5. The method of claim 4, further comprising attaching each radially-outward-projecting limit tab onto an outermost perimeter surface of the first scroll body.

6. The method of claim 1, further comprising configuring the pilot ring to fit precisely around a perimeter surface of the first scroll body so as to limit radial movement of the first scroll body.

7. A scroll compressor, comprising:

a housing;

scroll compressor bodies disposed in the housing, the scroll bodies including a first scroll body and a second scroll body, the first and second scroll bodies having respective bases and respective scroll ribs that project from the respective bases, wherein the scroll ribs mutually engage, the second scroll body being movable relative to the first scroll body for compressing fluid; and a pilot ring that engages a perimeter surface of the first scroll body to limit movement of the first scroll body in the rotational, axial, and radial directions, the first scroll body having a first radially-outward-projecting limit tab being configured to limit movement of the first scroll body in both the axial and rotational directions, wherein movement of the first scroll body in the axial direction is limited by the first radially-outward-protecting limit tab, which is configured to axially abut, and fit within, a notch formed into a bottom portion of the pilot ring.

8. The scroll compressor of claim 1, wherein the first radially-outward-projecting limit tab is attached to an outermost perimeter surface of the scroll rib of the first scroll body.

9. The scroll compressor of claim 1, wherein the first scroll body includes the first radially-outward-projecting limit tab and a second radially-outward-projecting limit tab, the first and second radially-outward-projecting limit tabs spaced approximately 180 degrees apart, and wherein the pilot ring has two notches adapted to receive the first and second radially-outward-projecting limit tabs.

10. The scroll compressor of claim 9, wherein movement in the rotational direction is limited by a third radially-outward-projecting limit tab on the first scroll body, wherein the third radially-outward-projecting limit tab is located within a slot formed in the pilot ring, and wherein the third radially-outward-projecting limit tab rotationally abuts a side portion of the slot.

11. The scroll compressor of claim 10, wherein the third radially-outward-projecting limit tab is attached to an outermost perimeter surface of the scroll rib of the first scroll body.

12. The scroll compressor of claim 10, wherein the third radially-outward-projecting limit tab has an opening configured to receive an axially-projecting portion of a key coupling to limit rotational movement of the key coupling.

13. The scroll compressor of claim 10, wherein movement in the rotational direction is further limited by a fourth radially-outward-projecting limit tab on the first scroll body, wherein the fourth radially-outward-projecting limit tab is configured to be received within a second slot formed in the pilot ring, and wherein the fourth radially-outward-projecting limit tab rotationally abuts a side portion of the second slot.

14. The scroll compressor of claim 1, wherein the pilot ring is formed separately from a crankcase, the pilot ring being attached to the crankcase via a plurality of posts extending axially therebetween, the first and second scroll bodies being disposed within the attached pilot ring and crankcase, and further comprising a key coupling that acts upon the second scroll body, the key coupling being disposed within the attached pilot ring and crankcase, and extending into spaces between adjacent posts, and whereby the spaces allow the pilot ring, crankcase, and key coupling to have outer diameters that are approximately equal to the inner diameter of the housing.

15. The scroll compressor of claim 14, wherein the pilot ring is mounted to the crankcase by a plurality of threaded fasteners.

16. The scroll compressor of claim 14, wherein a bottom surface of the pilot ring and a top surface of the crankcase include chamfered surfaces at the interface of the pilot ring and crankcase to facilitate the assembly thereof.

17. The scroll compressor of claim 14, further comprising a collar member configured to be assembled into a stepped interface of the crankcase, the collar member providing axial support for the second scroll body.

18. The scroll compressor of claim 17, wherein the configuration of the collar member allows for a counterweight to be located within the crankcase.

19. The scroll compressor of claim 1, wherein the radial movement of the first scroll body is limited by sliding cylindrical surfaces between the first scroll body and the pilot ring.

20. The scroll compressor of claim 1, wherein movement in the rotational direction is limited by the first radially-outward-projecting limit tab on the first scroll body, wherein the first radially-outward-projecting limit tab is located within a slot formed in the pilot ring, and wherein the first radially-outward-projecting limit tab rotationally abuts a side portion of the slot.

21. The scroll compressor of claim 20, wherein the first radially-outward-projecting limit tab is attached to an outermost perimeter surface of the scroll rib of the first scroll body.

22. The scroll compressor of claim 20, further comprising a key coupling that acts upon the second scroll body, and wherein the first radially-outward-projecting limit tab has an opening configured to receive an axially-projecting portion of the key coupling to limit rotational movement of the key coupling.

23. The scroll compressor of claim 22, wherein the first scroll body includes the first radially-outward-projecting limit tab and a second radially-outward-projecting limit tab with an opening configured to receive an axially-projecting portion of the key coupling, the first and second radially-outward-projecting limit tabs spaced approximately 180 degrees apart, and wherein the pilot ring has two respective slots adapted to receive the first and second radially-outward-projecting limit tabs.

24. The scroll compressor of claim 22, wherein movement of the first scroll body in the axial direction is limited by a third radially-outward-projecting limit tabs on the first scroll body, the third radially-outward-projecting limit tab configured to axially abut, and fit within, a notch formed into a bottom portion of the pilot ring.

25. A scroll compressor, comprising:

a housing;

scroll compressor bodies disposed in the housing, the scroll bodies including a first scroll body and a second scroll body, the first and second scroll bodies having respective bases and respective scroll ribs that project from the respective bases, wherein the scroll ribs mutually engage, the second scroll body being movable relative to the first scroll body for compressing fluid, the first scroll body having a plurality of radially-outward-projecting limit tabs; and a pilot ring removably attached to a crankcase, the pilot ring having a plurality of slots or notched sections configured to receive the corresponding plurality of radially-outward-projecting limit tabs disposed on the first scroll body, the pilot ring and plurality of radially-outward-projecting limit tabs configured to simultaneously restrict axial, radial, and rotation movement of the first scroll body.

26. The scroll compressor of claim 25, wherein the plurality of radially-outward-projecting limit tabs comprises four limit tabs attached to an outermost perimeter surface of the scroll rib of the first scroll body, the four radially-outward-projecting limit tabs spaced approximately 90 degrees apart around the circumference of the first scroll body.

27. The scroll compressor of claim 25, wherein the plurality of radially-outward-projecting limit tabs are designed to abut its respective slot or notched section to limit movement of the first scroll body in the axial, radial, and rotational directions.

* * * * *